US007215292B2

(12) United States Patent
McLean

(10) Patent No.: US 7,215,292 B2
(45) Date of Patent: May 8, 2007

(54) PXM ANTENNA FOR HIGH-POWER, BROADBAND APPLICATIONS

(75) Inventor: James S. McLean, Austin, TX (US)

(73) Assignee: TDK Corporation, Chiba (JP)

( * ) Notice: Subject to any disclaimer, the term of this patent is extended or adjusted under 35 U.S.C. 154(b) by 2 days.

(21) Appl. No.: 11/175,531

(22) Filed: Jul. 5, 2005

(65) Prior Publication Data

US 2006/0012535 A1 Jan. 19, 2006

Related U.S. Application Data

(60) Provisional application No. 60/587,318, filed on Jul. 13, 2004.

(51) Int. Cl.
*H01Q 21/00* (2006.01)

(52) U.S. Cl. ..... 343/725; 343/726; 343/867; 343/797

(58) Field of Classification Search ..... 343/741, 343/742, 860, 866, 867, 773, 797, 725, 726
See application file for complete search history.

(56) References Cited

U.S. PATENT DOCUMENTS

| | | | | |
|---|---|---|---|---|
| 2,490,815 A | | 12/1949 | Kandoian | |
| 3,247,515 A | * | 4/1966 | Boyer | 343/742 |
| 4,600,926 A | * | 7/1986 | Powell | 343/742 |
| 6,329,955 B1 | | 12/2001 | McLean et al. | |
| 6,515,632 B1 | | 2/2003 | McLean | |
| 6,600,451 B2 | * | 7/2003 | Mimura et al. | 343/741 |
| 6,960,984 B1 | * | 11/2005 | Vicci et al. | 340/10.1 |
| 2005/0057422 A1 | * | 3/2005 | Deguchi et al. | 343/867 |

FOREIGN PATENT DOCUMENTS

| | | |
|---|---|---|
| GB | 2 168 538 | 6/1986 |
| GB | 2 261 997 | 6/1993 |
| WO | 2004/049498 | 6/2004 |

OTHER PUBLICATIONS

Patent Abstracts of Japan, publication No. 03050922, published Mar. 5, 1991.
Patent Abstracts of Japan, publication No. 62216502, published Sep. 24, 1987.
European Search Report, EP 05 01 4488, mailed Oct. 18, 2005.
McLean, "The Application of the Method of Moments to the Analysis of Electrically-small 'Compound' Antennas," © 1995 IEEE, pp. 119-124.

* cited by examiner

*Primary Examiner*—Tan Ho
(74) *Attorney, Agent, or Firm*—Kevin L. Daffer; Daffer McDaniel, LLP

(57) ABSTRACT

A broadband antenna including both electric and magnetic dipole radiators is provided herein. The broadband antenna may be referred to as a "P×M antenna" and may include a pair of magnetic loop elements, each having multiple feed points symmetrically spaced around the loop element. The broadband antenna may also include an electric dipole element arranged between the pair of magnetic loop elements. In general, the electric dipole element and the magnetic loop elements may be coupled together through a network of transmission lines, as opposed to being incorporated into a single radiative element.

28 Claims, 4 Drawing Sheets

PXM ANTENNA FOR HIGH-POWER, BROADBAND APPLICATIONS

PRIORITY APPLICATION

This application claims priority to Provisional Application No. 60/587,318 entitled "P×M Antenna for High-Power, Broadband Applications," filed Jul. 13, 2004.

BACKGROUND OF THE INVENTION

1. Field of the Invention

This invention relates to antennas and, more particularly, to a practical implementation of a low-loss, broadband antenna incorporating electric and magnetic radiative components.

2. Description of the Related Art

The following descriptions and examples are not admitted to be prior art by virtue of their inclusion within this section.

Electrically-small antenna elements are utilized in many low frequency (e.g., mobile communications) and high frequency (e.g., EMC testing) applications. For example, an electrically-small antenna may be used in low frequency applications to accommodate space, durability or other concerns, or in high frequency applications to achieve a particular frequency level, which may be desired for EMC testing purposes. As used herein, the term "electrically-small" refers to an antenna or antenna element with relatively small geometrical dimensions compared to the wavelengths of the electromagnetic fields they radiate. Quantitatively speaking, electrically-small antennas are generally defined as antennas which fit inside a so-called radiansphere, or a sphere with a radius, $r=\lambda/2\pi$, where $\lambda$ is the wavelength of the radiated electromagnetic energy.

Unfortunately, electrically small antennas tend to have relatively large radiation quality factors, Q, meaning that they tend to store (on time average) much more energy than they radiate. This leads to input impedances that are predominantly reactive, which can make it difficult, if not impossible, to impedance match an electrically small antenna to an input feed over a broad range of bandwidths. Furthermore, due to the large radiation quality factor, the presence of even small resistive losses leads to very low radiation efficiencies in electrically small antennas (e.g., around 1–50% efficiency).

According to known quantitative predictions of the limits on the radiation Q of electrically small antennas, the minimum attainable radiation Q for any linearly polarized, omnidirectional antenna, which fits inside a spherical volume of radius, a, can be found by:

$$Q = \frac{1}{ka} + \frac{1}{k^3a^3} \qquad \text{(EQ. 1)}$$

where $k=1/\lambda$, the wave number associated with the electromagnetic radiation. Thus, the radiation Q of an electrically small antenna may be roughly proportional to the inverse of its electrical volume (a), or inversely proportional to the antenna bandwidth. In order to achieve relatively broad bandwidth and high efficiency with a single-element, electrically small antenna of a given size, it is desirable to utilize as much of the volume (that the antenna occupies) as possible. This may be achieved, in some cases, by increasing the size of the antenna elements, while retaining an electrically-small status.

In order to achieve the fundamental limit on radiation Q given in EQ. 1, an antenna would have to excite only the Transverse Magnetic ($TM_{01}$) or Transverse Electric ($TE_{11}$) mode outside of the enclosing spherical surface and store no electric or magnetic energy inside the spherical surface. So while, a short linear (electric) dipole excites the $TM_{01}$ mode outside of the sphere, it does not satisfy the criterion of storing no energy within the sphere, and thus, exhibits a higher radiation Q (and narrower bandwidth) than that predicted by EQ. 1.

In general, all antennas that radiate dipolar fields, such as electric and magnetic dipoles, are limited by the constraint given in EQ. 1. Though some broadband dipole designs have been successfully implemented and approach the limit given in EQ. 1, it is currently impossible to construct a linearly-polarized, omnidirectional antenna that exhibits a radiation Q less than that predicted by EQ. 1. However, while EQ. 1 represents the fundamental limit on the radiation Q for a linearly-polarized, omnidirectional antenna, it is not the global lower limit on radiation Q. For example, a compound antenna which radiates substantially equal power into the $TM_{01}$ and $TE_{11}$ modes can (in principle) achieve a radiation Q of approximately:

$$Q = \frac{1}{2}\left[\frac{2}{ka} + \frac{1}{k^3a^3}\right] \qquad \text{(EQ. 2)}$$

or roughly half that of an isolated electric or magnetic dipole, which radiates the $TM_{01}$ or $TE_{11}$ mode, alone. In other words, the impedance bandwidth of a compound antenna can be nearly double that of an isolated electric or magnetic dipole.

Ideal compound antennas having a pair of electrically-small electric and magnetic dipoles, which are co-located and oriented to provide orthogonal dipole moments, have been theoretically and numerically examined and found to provide useful features. Such antennas are often referred to as "P×M antennas," due to their orthogonal combination of electric (p) and magnetic (m) dipole vectors. Desirable characteristics of P×M antennas may include, but are not limited to, a useful radiation pattern (e.g., a low-gain, unidirectional radiation pattern) and a relatively broad impedance bandwidth for a given electrical size. As noted above, the radiation Q of an electrically-small P×M antenna is approximately half that of an isolated electric or magnetic dipole. Though the reduced Q should improve broadband impedance matching (at least in principle), practical implementations of P×M antennas have been problematic and have not been thoroughly investigated.

In order to provide broadband P×M operation, the dipole moments of the electric and magnetic radiators must be orthogonal in spatial orientation, substantially equal in magnitude, and in phase-quadrature over the desired operating frequency range. It is not difficult to specify the relationship between the magnitude and phase of two isolated radiators in a numerical or analytical model. In practice, however, such an antenna is usually driven from a single radio-frequency (RF) source, whose finite output impedance must be matched to the combined electric and magnetic radiator. This tends to be a particularly difficult problem due to the resonant nature of the combined electric and magnetic dipole radiator.

In some cases, a low-loss, passive feed or matching network may be used to combine the electric and magnetic radiators. However, such matching networks are often difficult to implement, due to the frequency-dependent variation in the input impedance of the two radiators. For example, variations in input impedance can make it difficult to maintain the proper magnitude and phase of the feed currents supplied to the electric and magnetic radiators. Furthermore, even when a matching network is used to combine the radiators, residual impedance mismatches may still limit the efficiency and power transfer of the antenna/matching network, and thus, the overall efficiency of the system. Although possible matching networks have been suggested, none of the currently known designs allow the combined radiator to operate efficiently over a broad range of frequencies. Therefore, the use of such designs often negates any improvements in bandwidth that may be provided by the lower radiation Q of the P×M radiator.

In principle, it should be possible to utilize electric and magnetic dipoles with complementary input impedances to provide the desired broadband operation. One such proven approach is the monopole-slot combination. This configuration is, in the ideal case, a true P×M radiator. For example, the monopole-slot antenna may be considered a two-port T-network formed with the radiation impedance of a slot antenna in the two series arms, and the radiation impedance of a monopole antenna in the shunt arm. The two-port T-network is usually terminated in a resistive load, whose value is equal to the image impedance of the T-network. However, use of a resistive load causes the antenna to have a lossy, low-pass characteristic. For this reason, the monopole-slot combination typically suffers from relatively low efficiency, even though the input impedance is more or less constant and matched. While the monopole-slot antenna is known to demonstrate a useful pattern behavior, the design is further burdened by the requirement of a ground plane.

Thus, two problems must be overcome to successfully implement a practical P×M antenna. First, practical electric and magnetic radiators must be found or designed, and second, a low-loss passive network to combine the two radiators must be implemented in such a way that P×M operation is maintained over some reasonable bandwidth. If resistive losses are to be kept to a minimum, the circulation of reactive power within the matching network must also be minimized.

As used herein, "P×M operation" is maintained when the electric and magnetic dipole moments are substantially orthogonal in spatial orientation, substantially equal in magnitude, and in phase-quadrature over a desired frequency range. In other words, the component radiators themselves must behave correctly—like electric and magnetic dipoles—so that the magnitude and phase of the far field components produced by each radiator will be in proper magnitude and phase for the superposition of the two to provide the desired performance. This enables the far field components of the electric and magnetic radiators to add up in phase.

For an isolated electrically-small electric or magnetic dipole, the above requirements are reduced to providing a matching network, which stores an opposite form of energy to that stored by the antenna. In other words, if efficiency is to be maximized, and both capacitive and inductive elements are available with the same radiation Q, a short electric dipole should be matched with an all-inductive matching network. Unfortunately, the situation is more complex with P×M antennas, since they store both electric and magnetic energy. Moreover, if the individual elements themselves are not electrically-small, each element will not store predominantly one form of energy. For example, a linear or tapered electric dipole of moderate electrical size will not store predominantly electric energy, but rather, will store both electric and magnetic energy with equipartition of energy achieved at resonance.

Thus, a need remains for a practical antenna design, which combines electric and magnetic dipole radiators to provide a low-loss, broadband implementation suitable for high-power applications.

SUMMARY OF THE INVENTION

The following description of various embodiments of antenna designs and methods is not to be construed in any way as limiting the subject matter of the appended claims.

The problems outlined above may be in large part addressed by an antenna that includes a pair of magnetic loops arranged within two spaced-apart, parallel planes. The magnetic loops may be aligned along an axis extending through center points of each of the magnetic loops and may include multiple feed points, which are symmetrically spaced about the axis. For this reason, the magnetic loops may be alternatively referred to as "multiply-fed" loops. Substantially any number of feed points may be included on each multiply-fed loop, depending on the desired operating frequency range. In some embodiments, the number of feed points may range between about 2 to 16 feed points. In one embodiment, four feed points may be symmetrically arranged around each loop. However, a greater/lesser number of feed points may be used to increase/decrease the usable bandwidth of the antenna. Regardless of the number of feed points used, stacking of the magnetic loops advantageously functions to reduce the radiation Q and extend the bandwidth of the antenna.

In some embodiments, an electric dipole may be arranged within another parallel plane between the pair of magnetic loops, such that the axis of the magnetic loops extends through a center point of the electric dipole. In this manner, the electric and magnetic radiators may be combined to form a P×M antenna with collocated phase centers. Though numerous forms of electric dipoles may be used, a biconical antenna may be preferred, in some embodiments of the invention, for its desirable operating frequency range. However, other electric dipoles, including linear dipoles, end-loaded dipoles and tapered dipoles, may be appropriate in alternative embodiments of the invention.

Therefore, a broadband antenna including both electric and magnetic dipole radiators is provided herein. The broadband antenna may be referred to as a "P×M antenna" and may include a pair of magnetic loop elements, each having multiple feed points symmetrically spaced around a periphery of the loop element. The broadband antenna may also include an electric dipole element arranged between the pair of magnetic loop elements. In most cases, the electric dipole element and the magnetic loop elements may be indirectly coupled together through a network of transmission lines, as opposed to being incorporated into a single radiative element.

In a specific embodiment, the multiple feed points of each loop may be connected in shunt due to the high driving point impedance at each feed point. However, they may also be driven via a hybrid network with the appropriate number of ports. In one configuration, four feed points in each loop may be connected via equal lengths of 400 Ohm, 2-wire transmission line to a common junction in the center of each loop. The 2 common junctions, in turn, may be connected via two 100 Ohm lines to a third common junction, and hence, a 50-ohm input transmission line in the center of the P×M antenna. In some cases, a feed network consisting, e.g., of a 90-degree hybrid network, may be used to split substantially equal amounts of input power between the magnetic loop antennas and the electric dipole antenna. The electric dipole antenna may be driven via any of numerous types of balancing networks including, but not limited to, voltage baluns, current baluns, 180-degree hybrid network, and equal-delay baluns.

A method of forming an antenna is also provided herein. In general, the method may include arranging a first multiply-fed loop within a first plane and arranging a second multiply-fed loop within a second plane, which is parallel to and spaced apart from the first plane. The first and second multiply-fed loops may be arranged, such that an axis of the loops extends through the center points of the first and second multiply-fed loops. The axis of the loops may be substantially orthogonal to the first and second parallel planes. In some embodiments, an electric dipole may be arranged within a third plane positioned between and parallel to the first and second planes. In this manner, a P×M antenna may be formed with collocated phase centers by arranging the electric dipole, such that the axis of the first and second multiply-fed loops is orthogonal to an axis of the electric dipole and extends through a center point of the electric dipole.

BRIEF DESCRIPTION OF THE DRAWINGS

Other objects and advantages of the invention will become apparent upon reading the following detailed description and upon reference to the accompanying drawings in which.

Figure 1:
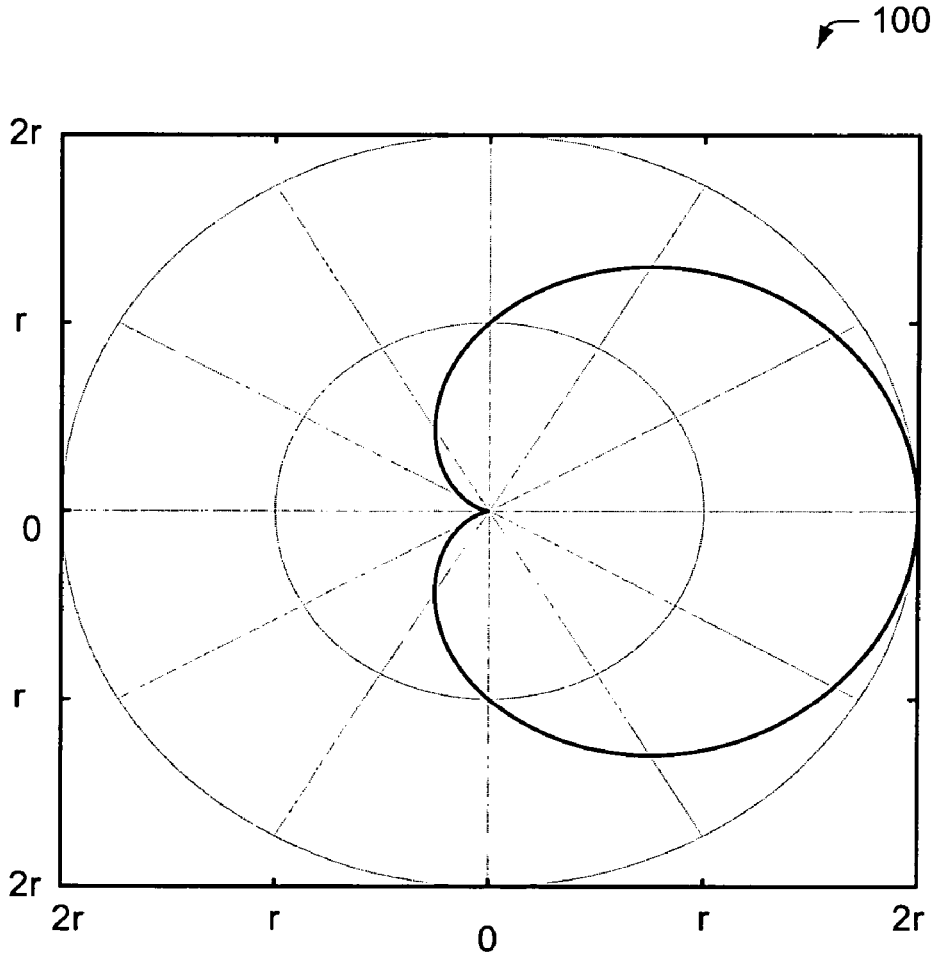
FIG. 1 is a polar plot of an exemplary cardioid-shaped radiation pattern.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

P×M antennas, so called because they are derived from an orthogonal combination of electric and magnetic radiators, possess several desirable characteristics including, but not limited to, a useful radiation pattern and relatively broad impedance bandwidth for a given electrical size. One form of the P×M antenna exhibits the radiation pattern of a hypothetical Huygens source. The radiation pattern, also referred to as the Ludwig-3 pattern, is a linearly-polarized unidirectional pattern comprised of a cardioid of revolution about the axis of maximum radiation intensity, and falls into the class of so-called maximum directivity patterns. As used herein, a "cardioid" is described as a heart-shaped curve traced by a point on the circumference of a circle rolling completely around another circle of fixed radius (r), and has the general equation of:

$$\rho = r*(1+\cos\theta) \qquad \text{(EQ. 3)}$$

in polar coordinates. A polar plot of a cardioid-shaped radiation pattern 100 is shown in FIG. 1. In the foregoing discussion, a cardioid-shaped radiation pattern may be otherwise referred to as a "P×M radiation pattern."

In principle, broadband P×M operation should be possible by combining electric and magnetic radiators with complementary input impedances. For example, a slot antenna may be the "complement" of an electric monopole (or dipole) antenna with similar dimensions as the slot antenna. According to Babinet's principle, the radiation pattern of a slot antenna in an infinitely large conducting sheet is the same as that of a complementary monopole (or dipole) antenna, except that the electric and magnetic fields are interchanged. Furthermore, the input impedances of a slot antenna and its complementary monopole are related by Booker's equation:

$$Z_{slot}Z_{monopole} = \frac{\eta^2}{4} \qquad \text{(EQ. 4)}$$

where $Z_{slot}$ and $Z_{monopole}$ are the input impedances of the slot and monopole antenna, respectively, and $\eta$ is the intrinsic impedance of the surrounding medium (e.g., $\eta=120\pi$ in free space). In other words, the input impedances of complementary antenna elements are roughly inversely proportional to one another. Therefore, when the complementary antenna elements are combined to form a single radiating structure, the complementary input reactances (i.e., the imaginary part of an impedance) may be cancelled, or reduced, to achieve a relatively matched input impedance over a wide range of frequencies.

When a ground plane is present, the slot antenna may perform similar to that of the monopole antenna (e.g., each radiator may provide approximately 2 octaves of impedance bandwidth). Therefore, the combination of the complementary monopole and slot antennas should provide relatively broadband P×M operation. However, in the absence of a ground plane, the magnetic dipole cannot be implemented with a slot antenna, and instead, must be implemented with some combination of loop antennas.

Simple combinations of magnetic loops and electric dipoles have been studied in the past. For example, a configuration has been presented in U.S. Pat. No. 6,329,955 entitled "Broadband Antenna Incorporating Both Electric and Magnetic Dipole Radiators," and incorporated herein in its entirety. In this patent, the present inventor provides another P×M configuration, which is basically a shunt connection between a magnetic loop and a tapered electric dipole with the connection being made at two points displaced from the base of the dipole. While this implementation provides almost 3:1 impedance bandwidth, the desired P×M radiation pattern is achieved over a relatively small range of operating frequencies (e.g., perhaps 20% fractional bandwidth).

Another previously studied combination includes a simple linear dipole and a single-turn, single-fed magnetic loop. This combination is described in a paper written by the present inventor, entitled "The Applications of the Method of Moments to Electrically-small 'Compound' Antennas," published in *IEEE Int. Symp. Electromagn. Compat. Symp. Rec.*, August 1995, pp. 119–124, and incorporated herein in its entirety. Unfortunately, this combination must contend with significant inter-element coupling within certain frequency ranges. For example, the component antennas may produce far fields equivalent to those of the $TE_{11}$ and $TM_{01}$ modes, which due to their orthogonality, demonstrate a zero inner product at substantially any radius. However, since the near fields of the component antennas are not orthogonal, some coupling between the antennas is to be expected. In other words, due to the lack of symmetry provided by a single feed, the combination of a simple linear dipole and a single-turn, single-fed magnetic loop exhibits significant inter-element coupling.

In addition, the magnetic loop in the above-mentioned design tends to be problematic in that the impedance of a simple single-turn loop is not precisely complementary to that of a short electric dipole. In other words, an electrically small, single-turn magnetic loop may appear to be somewhat complementary to an electrically short dipole, in that the loop is primarily inductive and the short linear dipole is primarily capacitive. However, the radiation impedances of the two antennas do not behave as lumped elements, but rather, vary with frequency. To complicate matters, the impedance variation with frequency is also different for each type of antenna. For these reasons, it is generally impossible to form a low-loss, broadband P×M antenna with a complementary combination of a linear (or tapered) dipole and a single-turn, single-fed magnetic loop. In addition, the radiation Q of a single-turn magnetic loop tends to be higher than the linear dipole, much higher than an end-loaded dipole, and, of course, much higher than the fundamental physical limit for radiation Q. As such, broadband impedance matching is often difficult, if not impossible, to achieve when attempting to match a single-turn, single-fed magnetic loop with a linear (or tapered) dipole.

Figure 2:
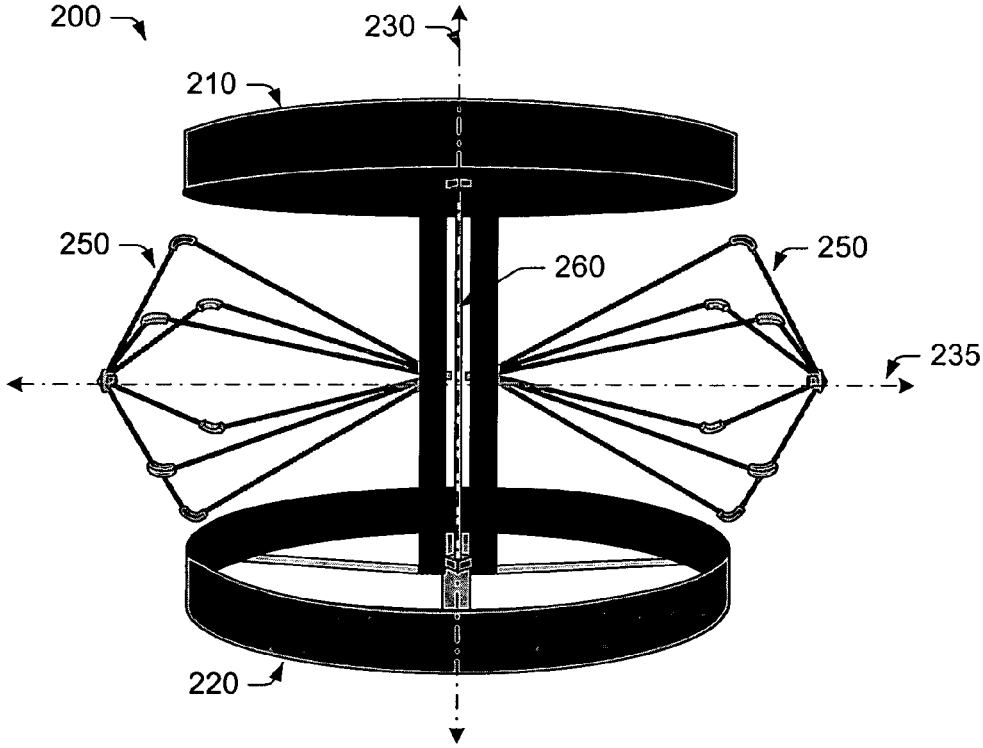
FIG. 2 is a side view of an exemplary P×M antenna comprising electric and magnetic antenna components in accordance with one embodiment of the invention.
Figure 3:
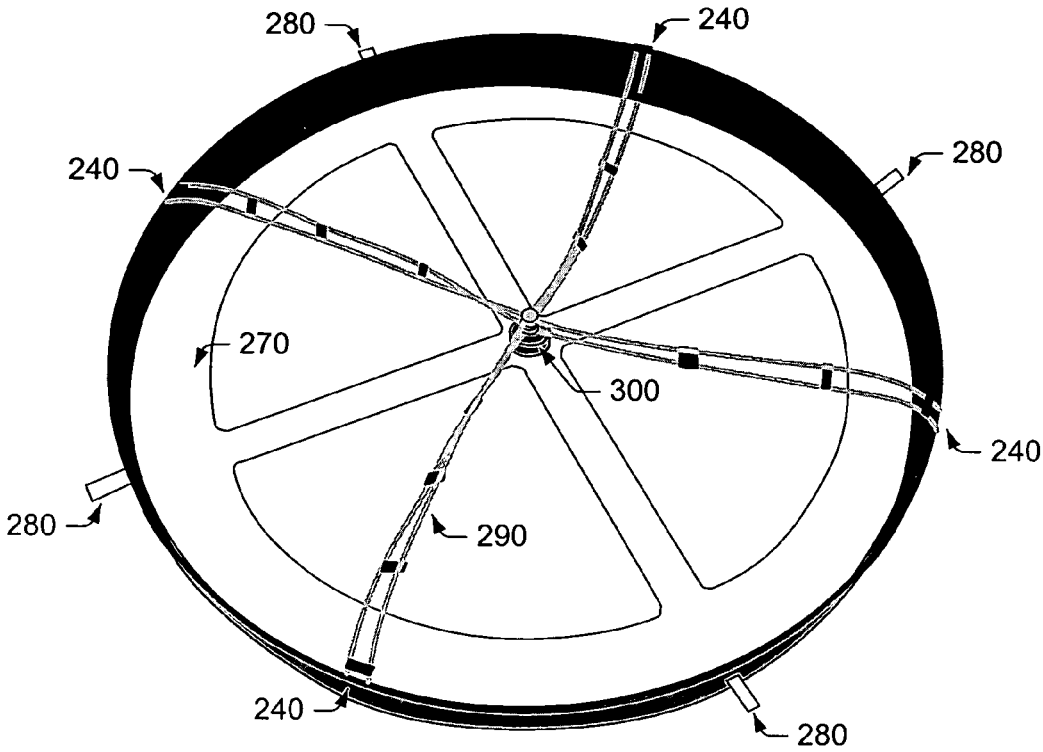
FIG. 3 is a top view illustrating one of the magnetic antenna components shown in FIG. 2.

Turning now to the drawings, FIGS. 2 and 3 illustrate an exemplary antenna 200 incorporating electric and magnetic radiators, according to one embodiment of the invention. As described in more detail below, P×M antenna 200 demonstrates one manner in which a realistic, low-loss, broadband P×M antenna design may be implemented. Other implementations and/or variations are possible and within the scope of the invention. In the following discussion, exemplary broadband electric and magnetic dipoles will be investigated, followed by an exemplary means for combining the two dipole elements in the P×M configuration.

FIGS. 2 and 3 illustrate one embodiment of a realistic, low-loss, broadband P×M antenna design. In particular, FIG. 2 shows a side view of P×M antenna 200, whereas FIG. 3 shows a top view of one of the magnetic loops included within P×M antenna 200. As shown in FIG. 2, P×M antenna 200 includes a pair of magnetic loops 210, 220 arranged within two spaced-apart, parallel planes. The magnetic loops are aligned along an axis 230 extending through center points of each of the magnetic loops, and as such, may be referred to as "stacked" loops. In some embodiments, the magnetic loops may be fed at a single feed point. In other embodiments, however, magnetic loops 210, 220 may each include multiple feed points 240, which are symmetrically spaced about the loop. In the embodiments which include multiple feed points, the magnetic loops may also be referred to as "multiply-fed" loops.

In order to produce a P×M radiation pattern (as shown, e.g., in FIG. 1), magnetic loops 210, 220 must be combined with a complementary electric radiator. In the embodiment of FIG. 2, an electric dipole 250 is arranged between the pair of magnetic loops within a plane, which is parallel to and located a substantially equal distance between the parallel planes of the magnetic loops. Like the magnetic loops, electric dipole 250 may also be aligned, such that axis 230 extends through the center point of the electric radiator. As described in more detail below, this allows the electric and magnetic radiators to be combined to form a P×M antenna with collocated phase centers.

I. Exemplary Broadband Electric Radiators

There are numerous approaches for obtaining broadband electric dipole performance. In the embodiment of FIG. 2, a wire-cage implementation of a biconical antenna 250 is used to implement the electric dipole portion of the P×M antenna. Though other electric dipoles including, e.g., top (i.e., end-loaded), flat or tapered dipoles, may be used in place of the biconnical antenna in other embodiments of the invention, biconical antenna 250 may be preferred due to its desirable impedance bandwidth. In one embodiment, biconical antenna 250 employs a 60° cone angle and is about 1.3 meters wide. One reason for choosing such a cone angle is that a 60-degree cone provides approximately 2 octaves of operating bandwidth over which it is relatively well matched to a 200 Ohm source and provides a useable pattern. However, other angles and widths are certainly possible and within the scope of the invention.

There are also many ways in which biconical antenna 250 may be formed. For example, biconical antenna 250 may be formed by arranging a pair of cone-shaped elements "back-to-back" to one another and aligning the cone-shaped elements along an axis, which extends through a center point of the elements along a length of the elements.

In some cases, the cone-shaped elements of biconical antenna 250 may be formed from a substantially solid, electrically-conductive material. For example, each cone-shaped element may be cut, or otherwise formed, from a solid piece of metal (e.g., cupper, aluminum, etc.), which may or may not include a hollow center. In other cases, the cone-shaped elements may be fabricated by bending a substantially flat piece of wire mesh into a three-dimensional, cone-shaped structure. In the embodiment of FIG. 2, the cone-shaped elements are each formed by coupling together a plurality of metal wires or rods to form a cone-shaped structure. Such an embodiment may be referred to as a "wire-cage" implementation, and may be preferred in some embodiments of the invention. For example, a wire-cage implementation may simplify the manufacturing process, as well as provide a robust antenna design.

Regardless of the particular manner in which biconical antenna 250 is formed, the dimensions of the antenna may be chosen based on a desired operating frequency range of the combined P×M antenna. For example, biconical antenna 250 may be formed with a 60° cone angle and may be about 1.3 meters in length, in some embodiments of the invention. Such an antenna may provide approximately 4:1 bandwidth (i.e., 2 octaves), and may be appropriate for use in EMC testing applications, such as immunity testing. However, the dimensions of biconical antenna 250 are not limited to only those described above. In some cases, a much smaller version of biconical antenna 250 may be used if P×M antenna 200 is to be incorporated, e.g., within portable or handheld devices (such as laptops, cell phones, PDAs, etc.). In such cases, the length of biconical antenna 250 may be scaled down to a range of about 1/10 to about 1/100 (or greater) of the above-mentioned size. In a general embodiment, the electrical length of biconical antenna 250 may range between about 1/3 wavelength to about 4/3 wavelength over the operating frequency range, with a center frequency of about 2/3 wavelength. It should be recognized, however, that the design could be scaled to have substantially any center frequency, while maintaining the same fractional operating frequency range (e.g., about 2 octaves).

In some cases, biconical antenna 250 may be driven with a balancing network incorporating a 2:1 voltage ratio. That is, the balancing network may include a voltage balun (not shown) with a 50 Ohm coaxial input port and 200 Ohm balanced port. Alternative balun configurations may be possible in other embodiments of the invention. For example, as long as symmetry is maintained, a voltage balun, current balun, or hybrid balun could be used in other embodiments of the invention. There are numerous implementations for these fundamental types. In practice, equal-delay or Guanella topolgies are generally used for the realization of all three balun types. However, other topologies may be used, such as lattice, double-y, faraday transformer, or even a 180-degree hybrid realized from a 90-degree coupled line hybrid with a Schiffmann type 90-degree phase shifter (this is a typical commercial UHF/microwave design).

A primary reason for using biconical antenna 250 is that essentially all of its aspects have been extensively studied. The biconical antenna design provides approximately 2 octaves of operating bandwidth over which the antenna is reasonably well matched and the radiation pattern is fairly well behaved. The lower end of the operating bandwidth is generally limited by impedance mismatch, while the upper end is limited by pattern degradation. In addition, a high-power design for 5 kW continuous available power was already commercially available. The only drawback to the biconical antenna design of FIG. 2 is the relatively large size of the balun. Unfortunately, any high-power balun must be somewhat large. In order to minimize unwanted coupling to the magnetic dipole, as well as disturbance of the electric dipole fields, the balun may be removed from the center of the biconical antenna structure and a 200 Ohm balanced line may be inserted between the balun and the base of the dipole elements.

The percentage of total power radiated in the $TM_{01}$ mode can be used to provide an indication of the performance capabilities of the biconical antenna 250 in isolation. It is noted, however, that some change in behavior is to be expected when the biconical antenna is combined with the magnetic loop (as described in more detail below).

By determining the coefficient of the $TM_{01}$ mode in a spherical wave function expansion of an antenna's radiated fields, it is possible to determine how much power is radiated in the $TM_{01}$ mode and hence the fraction of the total radiated power carried by the $TM_{01}$ mode. Numerical analsysis based on a moment method indicates that biconical antenna 250 produces an essentially pure $TM_{01}$ mode at the lower limit of its impedance bandwidth where the antenna is about 1/3 of a wavelength in length. At an octave above this frequency (where the antenna is about 2/3 of a wavelength in length), the fraction of radiated power in the $TM_{01}$ mode drops to about 91 percent. Finally, at the upper end of the frequency range (where the antenna is about 4/3 of a wavelength in length), the fraction of power radiated in the $TM_{01}$ mode falls to about 70 percent. For the particular geometry shown in FIG. 2, the radiation pattern developed a quasi-null in the H-plane at approximately 330 MHz as the $TM_{03}$ mode becomes significant. In other words, P×M operation ceases when the electric dipole antenna no longer produces predominantly $TM_{01}$ mode, but rather produces $TM_{03}$, since the electric dipole component is no longer present.

II. Exemplary Broadband Magnetic Radiators

In general, the magnetic dipole portion of the P×M antenna is more difficult to implement over a broad bandwidth than the electric dipole. In theory, it would be useful if one could implement a magnetic radiator that is exactly complementary to the tapered electric dipole (e.g., biconical antenna 250) shown in FIG. 2. In some cases, for example, a pair of magnetic loops 210, 220 may be used as a complementary radiator to the tapered electric dipole. In general, the magnetic loops may each be formed from an electrically conductive material (e.g., any conductive material, such as copper, aluminum, or even conductive-filled plastics). In one embodiment, the magnetic loops may be formed from a continuous sheet of conductive material, which has been cut to size and bent into a substantially circular shape. In other embodiments, however, the magnetic loops may be fabricated by attaching one or more portions of the conductive material to a non-conducting form (e.g., a plastic ring).

Regardless of how they are formed, magnetic loops 210 and 220 must be fabricated to match the electric dipole included within the P×M antenna, as well as the resistive source impedance supplied thereto. In some cases, magnetic loops 210 and 220 may be single-turn loops (e.g., approximately 1 meter in diameter, or in general, about 1/4 wavelength to about 1 wavelength in diameter), which are aligned along their axes and spaced approximately 0.75 meters apart. Though alternative spacings may be used, the above spacing provides some length for the magnetic radiator in the axial direction, and hence, reduces the radiation Q to some degree. Due to their relatively large size, the conductive portions of the magnetic loops may be reinforced, in some embodiments, by electrically non-conductive support members 270. However, support members 270 may not be necessary in embodiments, which employ substantially smaller magnetic loops (e.g., those approximately 1/10 to 1/100 of their original size).

In some cases, when a loop antenna is made large enough to be matched to a resistive source impedance over a broad frequency range, it may no longer exhibit the radiation pattern of a magnetic dipole. When the radiation pattern of either component antenna, the electric or magnetic dipole, deviates from its ideal characteristics (shape, polarization, etc.) the pattern of the combined P×M antenna also deviates from the ideal. Therefore, it is generally desired that the component antennas behave like electric and magnetic dipoles to the extent that it is possible.

One reason for the departure of the radiation pattern from that of a magnetic dipole is the retardation of the current around the magnetic loop. One approach for overcoming this problem includes placing lumped capacitive loads in the antenna and feeding the antenna in more than one position. As shown in FIG. 3, for example, magnetic loops 210, 220 each include four feed points 240 and four series capacitances 280 placed symmetrically around the loop. However, the capacitances are typically not placed at the same location as the feed points. In one example, a single series capacitance may be placed exactly in the middle between each of the feed points, as shown in FIG. 3. Other arrangements or implementations may be appropriate in alternative embodiments of the invention.

In some cases, magnetic loops 210 and 220 may be referred to as "multiply-fed" loops due to the multiple feed points included on each loop. Although FIG. 3 illustrates a particular number of feed points and capacitors, magnetic loops 210 and 220 may include substantially any number of feed points and capacitors, depending on the desired operating frequency range and matching considerations. For example, each magnetic loop may include a number of feed points selected from a range of about 2 to about 16. The same can be said for the number of capacitors. In the current embodiment, four feed points and four capacitors were chosen, due to the relatively well matched impedance of the four feed points to a 400 Ohm transmission line.

In some cases, the feed points in each magnetic loop may be connected to a central junction (300, FIG. 3) via a transmission line commonly referred to as a "ladder line." In one embodiment, the ladder lines (290, FIG. 3) may include two 18 AWG solid conductors spaced approximately 0.75 inches apart. A ladder line may be included for each feed point (in one example, four feed points) on each magnetic loop. All ladder lines are formed substantially identical to one another and are substantially equal in length. Though such ladder lines are commonly advertised to exhibit a 450 Ohm characteristic impedance, the actual characteristic impedance is more often close to about 400 Ohms. Thus, the four 400 Ohm balanced transmission lines may be connected to the central junction 300 in the center of the loop. The central junctions within each loop may then be connected by two 100 Ohm coaxial transmission lines (260, FIG. 2). In some cases, ferrite choke sleeves (not shown) may be used on the outside of the central junction to resist common mode current (if necessary).

The magnetic loops may then be coupled to the electric dipole. In one example, the two 100 Ohm coaxial lines (260) from magnetic loops 210 and 220 may be connected to a third common junction (e.g., an unmatched T-junction), and hence, to a 50-Ohm input/output port transmission line in the center of the electric dipole antenna. It is noted that shunt connections are acceptable because the input impedance at each input port is identical. This is discussed further in regards to combining the loop and dipole antennas.

Similar to the electric dipole, the percentage of total power radiated in the $TE_{11}$ mode may provide an indication of the performance of an isolated magnetic loop radiator. It is noted, however, that some change in behavior is to be expected when the magnetic loop is combined with the dipole antenna (as described in more detail below). While the isolated magnetic loop produces very pure $TE_{11}$ mode at approximately 100 Mhz (where the loop is approximately ⅓ wavelength in diameter), the fraction of radiated power in the $TE_{11}$ mode falls off monotonically to 85 percent at approximatley 240 Mhz (where the loop is approximately ⅘ wavelength in diameter). For this reason, the loop antenna is not quite as good at producing pure $TE_{11}$ mode as the biconical dipole is at radiating pure $TM_{01}$ mode. The loop antenna is also not as well matched to the RF source as the biconical dipole. However, it does exhibit reasonably broad bandwidth (e.g., more than one octave).

In some cases, high-pass matching components (e.g., a high-pass ladder network of series capacitances and shunt inductances) may be used to extend the performance of loop antennas 210 and 220 to a substantially lower frequency (e.g., it may be possible to get 2 octaves of bandwidth out of the loop antenna with proper matching). It should be pointed out, however, that the high impedance level of loop antennas 210 and 220 can make impedance matching a bit difficult. Parasitic shunt capacitance near the feed regions on the order of a picofarad are significant. To facilitate matching, small values of capacitance (e.g., about 5 pF) may be used for embedded series capacitors 280. In some cases, it may be desirable to employ so-called "wire gimmick" capacitors to allow for easy adjustment.

III. Combining the Electric and Magnetic Radiators Into a P×M Configuration

Exemplary electric and magnetic radiators for use in P×M antenna 100 have now been described in accordance with one preferred embodiment. Before proceeding, it is worthwhile to note some important features of the P×M antenna design provided herein. First, because of the non-ideal radiation Q of an electrically-small magnetic loop (e.g., a radius of about $\lambda/2\pi$), electric and magnetic component antennas of moderate electrical size (e.g., about ¼–⅓ wavelength to about ⅔–1 wavelength in diameter) were chosen for this version of the P×M antenna. In some embodiments, a multiply-fed loop of moderate electrical size may be similar to the one disclosed in U.S. Pat. No. 6,515,632, which is assigned to the present inventor and incorporated herein in its entirety. While component antennas of moderate electrical size greatly facilitate impedance matching, prescribed low-order element radiation patterns may be slightly more difficult to obtain. Second, and as described in more detail below, the components may be combined into a P×M configuration using a hybrid combining network, as opposed to incorporating the components into a single radiating element. This also simplifies the design of the antenna.

As noted above, a P×M radiation pattern is a linearly-polarized unidirectional pattern comprised of a cardioid of revolution about the axis of maximum radiation intensity. An exemplary P×M radiation pattern is shown in FIG. 1. In order to maintain a P×M radiation pattern over a broad range of frequencies, the dipole moments of the electric and magnetic radiators must be substantially orthogonal in spatial orientation, substantially equal in magnitude, and in phase-quadrature over the broad frequency range. When the component radiators themselves behave correctly—like electric and magnetic dipoles—the magnitude and phase of each radiator will be properly oriented to provide the desired performance in the far field. In other words, the elementary electric dipole pattern alone exhibits a defined phase center; that is, the phase of the radiation pattern at a given frequency is substantially constant with direction. The same is true for the elementary magnetic dipole.

However, a radiation pattern composed of a combination of these two patterns will exhibit a constant phase pattern only if the far field patterns of the elements are also combined in phase. For this reason, the electric and magnetic radiators must be combined so that their phase centers are "collocated." In one embodiments, the center points of magnetic loops 210, 220 and electric dipole 250 may all be aligned along the same axis (230), as shown in FIG. 2. In other words, the center points of magnetic loops 210, 220 and electric dipole 250 may be "collocated."

Because of the requirement for collocation, the combination of electric and magnetic radiators into a functional P×M configuration is not straightforward. In order to minimize undesirable coupling between the electric and magnetic components and to maintain the P×M characteristics of the antenna, the feed points of loop antennas 210 and 220 are symmetrically arranged with respect to the horizontal axis 235 of electric dipole 250. In other words, the axes of the magnetic loop antennas and the electric dipole are perpendicular to one another, but intersect at the center of each dipole. The feed points on each loop are arranged around the loop so that they are symmetric with respect the electric dipole axis (235).

By symmetrically arranging multiple feed points 240 around the loop, excitation at the input/output port of either the magnetic loop 210, 220 or the electric dipole 250 does not produce any response at the other port. In other words, the off-diagonal terms in a two-port network matrix representation of P×M antenna 200 are substantially zero. However, there is still a reaction on the driven port as evidenced by the input impedance at either port. Note that the input impedance at either input/output port is independent of the termination on the other port and also independent of any excitation at the other port. Thus, there is no reason to define an "active" input impedance, as oftentimes done in other designs. However, since this isolation is dependent on the symmetry of the system, the lengths of the component transmission lines, as well as the mechanical dimensions of the antennas and supporting structure may be bound, in some cases, by relatively tight tolerances.

In order to reduce the radiation Q and extend the useful bandwidth of the P×M antenna, the magnetic loop elements may be "stacked," as shown in FIG. 2. In the particular embodiment shown, the magnetic loops are arranged within parallel planes that are spaced apart by approximately 0.75 meters. This may provide sufficient distance for the magnetic loops to radiate in the axial direction (230), which is orthogonal to the parallel planes and extends through a center point of each loop. Smaller or larger spacings may be appropriate depending on a particular diameter used to implement the loop antennas. In general, stacking of the loops increases the length in the axial direction (230), and thus, increases the loop dipole moments to reduce the radiation Q and extend the useful bandwidth of the P×M antenna.

In order to provide the desired P×M radiation pattern, the magnitude and phase of the two component spherical modes should be maintained over the operating frequency range. To do so, an exemplary network is provided herein for combining the component antennas in the P×M configuration. Such a network may be described in terms of the transfer functions for the two component antennas and may be used, in some embodiments, instead of incorporating the components into a single radiating element (i.e., instead of physically connecting the components to form one radiative structure).

For example, the transfer function for the $TM_{01}$ mode of the electric dipole may be defined as the ratio of the maximum electric field (in the x-y plane) associated with the radiated $TM_{01}$ mode to the incident voltage at the input port of the electric dipole. The reason for this choice is that it is fairly straightforward to specify the incident voltage when a hybrid network is used to drive the electric and magnetic component radiators. On the other hand, it is often difficult to specify the port voltage or current, especially when intervening lengths of transmission lines exist and impedance mismatch between the antennas and the source is not negligible. The transfer function of the magnetic loop may be defined in a similar fashion except with the $TE_{01}$ mode rotated 90°. This is equivalent to specifying the $TE_{11}$ mode. The two transfer functions provide the information needed to implement a phase equalizer for the electric and magnetic component antennas. As used herein, a "phase equalizer" may be described as an all-pass network that provides a necessary transfer function to bring the dipole moments into proper phase.

Figure 4:
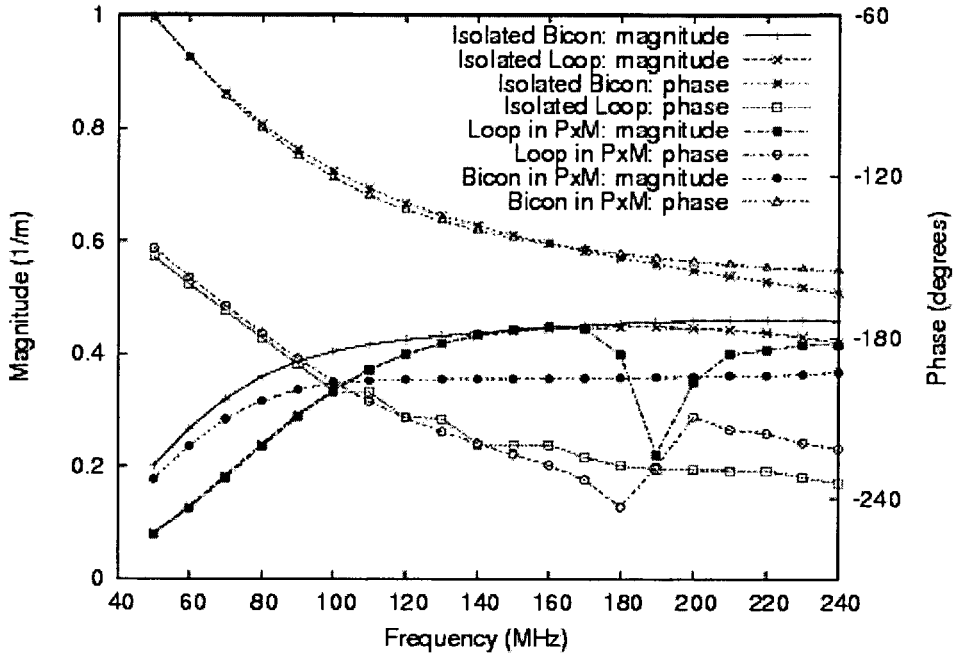
FIG. 4 is a graph illustrating exemplary transfer functions of the electric and magnetic antenna components of FIG. 2 in isolation and when embedded within the P×M antenna of FIG. 2.

In the graph of FIG. 4, transfer functions for the electric and magnetic components of P×M antenna 200 are plotted for two cases: 1) when the components are provided in isolation, and 2) when the components are embedded within the P×M antenna. The transfer functions of FIG. 4 illustrate that a 90° hybrid network would provide phase compensation reasonably close to ideal (i.e., substantially equal phase over the entire operating frequency range). For example, FIG. 4 shows that the electric fields produced by each radiator are very nearly 90° apart when collocated (i.e., the "Loop in P×M: phase" and the "Bicon in P×M: phase" graphs are approximately 90° apart at 240 MHz). In one embodiment, a 4-port hybrid feed network with two isolated output ports (each with 50 Ohm impedance) may be used to split the input power between the electric and magnetic radiators, and thus, drive the electric and magnetic component radiators with the appropriate phase compensation. The hybrid network is referred to as a 90-degree hybrid since the output ports of the hybrid network are isolated and are 90° apart in phase. In some cases, a small time delay may be added to bring the phase of the component radiation patterns even closer to the ideal relationship. For example, a simple transmission delay line may be added to provide a linear phase shift.

Figure 5:
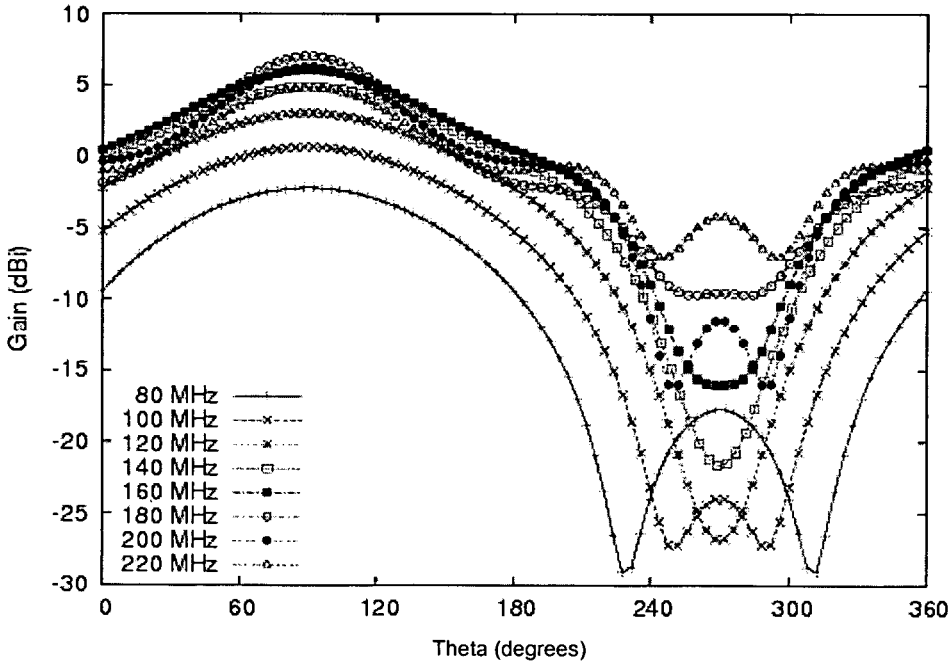
FIG. 5 is a graph illustrating exemplary E-plane radiation patterns for the P×M antenna of FIG. 2.
Figure 6:
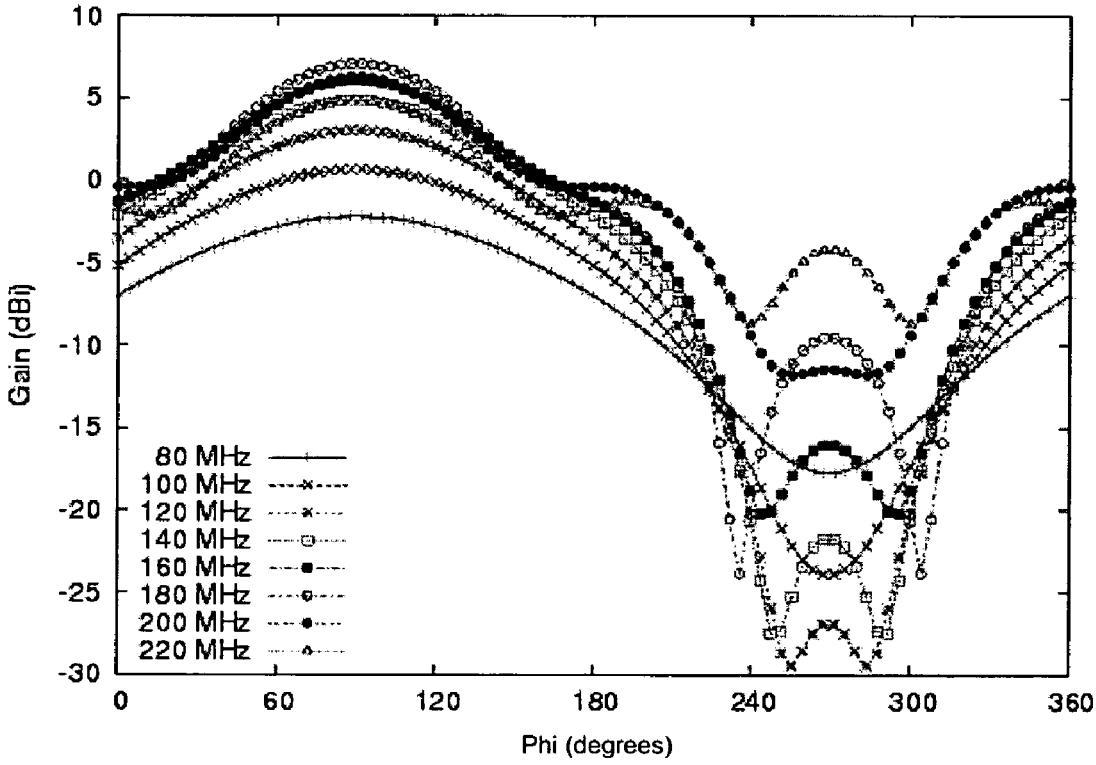
FIG. 6 is a graph illustrating exemplary H-plane radiation patterns for the P×M antenna of FIG. 2.

The resulting E-plane and H-plane radiation patterns for P×M antenna 200 are presented in FIGS. 5 and 6, respectively. The gain presented in FIGS. 5 and 6 includes a 90° phase shift and mismatch loss, and thus, indicates the actual transmitting capability or realized gain of the antenna. The angles $\theta$ and $\phi$ are measured in a traditional right-handed spherical coordinate system.

One feature of the P×M antenna radiation pattern deserves more consideration as it relates to Ultra-Wide Band (UWB) pulse transmission. The elementary electric dipole pattern alone exhibits a defined phase center; that is, the phase of the radiation pattern at a given frequency is constant with direction. The same is true for the elementary magnetic dipole. However, a radiation pattern composed of a combination of these two patterns will exhibit a constant phase pattern only if the far field patterns of the elements are also combined in phase. For example, it is known that a nearly spherical power pattern can be obtained using a combination of two crossed electric or magnetic dipoles, sometimes referred to as a "turnstile antenna." However, because the far field patterns of the component radiators are combined in phase quadrature, the resulting pattern exhibits a phase variation with direction. In the time domain, there is a complete decorrelation of signals transmitted in the direction of the axis of one dipole with those transmitted in the direction of the axis of the other. This is due to the Hilbert transforming effect of the phase quadrature frequency domain relationship. On the other hand, the P×M radiation pattern exhibits constant phase, and thus, exhibits a correlated energy gain pattern identical to the total energy gain pattern. Thus, the distortion (or lack thereof) of time-domain pulses by a true P×M antenna is independent of angle provided that the spectrum of the pulse lies in the frequency range over which P×M operation is maintained. If the antenna distorts a time domain pulse in a similar manner for all directions, the distortion may be corrected with a single fixed equalizer connected to the input/output of the antenna.

A practical implementation of a low-loss, broadband P×M antenna has been presented herein. The P×M antenna design described above provides about 2 octaves of operating bandwidth. One distinct advantage of the P×M antenna is the true collocation of the phase centers of the component antennas. If the phase centers of the components were not colocated, the desirable radiation pattern of the P×M antenna could not be achieved. This makes little difference when the P×M antenna is electrically-small. However, when the antenna is of moderate electrical size (as it must be to be very broadband), collocating the phase centers of the component antennas makes a very large performance difference. In addition, stacking of the magnetic loops functions to reduce the radiation Q and enhance the bandwidth of the antenna. Furthermore, the results of the numerical simulations shown in FIGS. 4–6 clearly indicate that the multiple feed system for the magnetic loop greatly extends the useful bandwidth of this component, and that inter-port coupling of the electric and magnetic component antennas can be minimized with the symmetric feed point design.

Though the realization of a broadband magnetic dipole is still a limiting factor of the P×M antenna described herein, it may be be possible to extend the feed system of the multiply-fed loop to employ an even greater number of feed points. This may increase the upper frequency limit of operation, as well as reduce the required characteristic impedance of the interconnecting transmission lines. Thus, increasing the number of feed points may greatly facilitate the implementation of the loops in planar media. Though the multiply-fed loops may include substantially any number of feed points, the practical limitation in increasing the number of feed points lies in the complexity of the shunt connection at the center of the loop. Finally, high-pass matching elements (e.g., a high-pass ladder network of series capacitances and shunt inductances) may be inserted at the feed points to further improve the impedance bandwidth of the loop antenna.

It will be appreciated to those skilled in the art having the benefit of this disclosure that this invention is believed to provide a practical implementation of a low-loss, broadband P×M antenna. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. An antenna, comprising:

a pair of magnetic loops arranged within two spaced-apart, parallel planes and aligned along an axis extending through center points of each of the magnetic loops, wherein the magnetic loops each comprise multiple feed points symmetrically spaced about the axis; and an electric dipole arranged within another parallel plane between the pair of magnetic loops, such that the axis of the magnetic loops extends through a center point of the electric dipole.

2. The antenna as recited in claim 1, wherein the electric dipole is selected from a group of antennas comprising linear dipoles, end-loaded dipoles and tapered dipoles.

3. The antenna as recited in claim 2, wherein the electric dipole is a biconical antenna.

4. The antenna as recited in claim 3, wherein the biconical antenna has a 60-degree cone angle.

5. The antenna as recited in claim 3, wherein the biconical antenna ranges between about ⅓ wavelength to about ⅔ wavelength in length over an operating frequency range of the antenna.

6. The antenna as recited in claim 5, wherein each magnetic loop ranges between about ¼ wavelength to about 1 wavelength in diameter over the operating frequency range.

7. The antenna as recited in claim 1, wherein each magnetic loop comprises a number of feed points selected from a range of values comprising about 2 to about 16.

8. The antenna as recited in claim 7, wherein each magnetic loop comprises four (4) feed points symmetrically spaced around a periphery of the loop.

9. The antenna as recited in claim 1, further comprising a plurality of capacitors individually coupled to and symmetrically spaced around a periphery of each magnetic loop.

10. The antenna as recited in claim 9, wherein each magnetic loop comprises a number of capacitors selected from a range comprising about 2 to about 16.

11. The antenna as recited in claim 10, wherein each magnetic loop comprises four (4) capacitors symmetrically spaced around the periphery of the loop at locations that differ from those of the multiple feed points.

12. A broadband antenna comprising both electric and magnetic dipole radiators comprising:

a pair of magnetic loop elements, each comprising multiple feed points symmetrically spaced around a periphery of the loop element;

an electric dipole element arranged between the pair of magnetic loop elements, wherein the electric dipole element and the magnetic loop elements are coupled together through a network of transmission lines.

13. The broadband antenna as recited in claim 12, wherein the pair of magnetic loop elements are arranged within two spaced-apart parallel planes, wherein the electric dipole element is arranged within a third plane between and parallel to the spaced-apart parallel planes, and wherein the pair of magnetic-loop elements and the electric dipole element are each aligned along a common axis, which is perpendicular to all three parallel planes and extends through center points of the pair of magnetic-loop elements and the electric dipole element.

14. The broadband antenna as recited in claim 13, wherein the multiple feed points of a given magnetic loop element are coupled to a common junction at a center point of the magnetic loop element via equal lengths of transmission lines.

15. The broadband antenna as recited in claim 14, wherein the common junctions of the pair of magnetic loop elements are coupled together via equal lengths of transmission lines to another common junction arranged between the pair of magnetic-loop elements.

16. The broadband antenna as recited in claim 15, further comprising a feed network coupled to the network of transmission lines and configured for splitting substantially equal amounts of input power between the pair of magnetic loop elements and the electric dipole element.

17. The broadband antenna as recited in claim 16, wherein the feed network comprises a 90-degree hybrid network.

18. The broadband antenna as recited in claim 16, wherein the electric dipole element is driven by a balancing network selected from a group comprising: voltage baluns, current baluns, 180-degree hybrid networks, and equal-delay baluns.

19. The broadband antenna as recited in claim 16, further comprising a high-pass matching element coupled to each of the multiple feed points, wherein the high-pass matching element comprises a series connection of one or more capacitors or inductors.

20. A method of forming an antenna, comprising:

arranging a first multiply-fed loop within a first plane, wherein an axis extending through a center point of the first multiply-fed loop is orthogonal to the first plane;

arranging a second multiply-fed loop within a second plane parallel to and spaced apart from the first plane, wherein an axis extending through a center point of the second multiply-fed loop is collinear to the axis of the first multiply-fed loop; and arranging an electric dipole within a third plane positioned between and parallel to the first and second planes, wherein the collinear axes of the first and second multiply-fed loops extend through a center point of the electric dipole.

21. The method as recited in claim 20, wherein each of the first and second multiply-fed loops are formed from a continuous strip of electrically conductive material.

22. The method as recited in claim 20, wherein each of the first and second multiply-fed loops are formed by attaching one or more strip-like portions of electrically conductive material to a surface of a non-conducting circular support structure.

23. The method as recited in claim 20, wherein the electric dipole is formed by arranging a pair of cone-shaped elements back-to-back to one another and aligning the cone-shaped elements along another axis, which is substantially perpendicular to the axis extending through the center points of the first and second multiply-fed loops and the electric dipole.

24. The method as recited in claim 23, wherein the cone-shaped elements are each formed from a substantially solid electrically-conductive material.

25. The method as recited in claim 23, wherein the cone-shaped elements are each formed from a wire-mesh, electrically-conductive material.

26. The method as recited in claim 23, wherein the cone-shaped elements are each formed by coupling together a plurality of metal wires or rods to form a cone-shaped structure.

27. The method as recited in claim 20, further comprising indirectly coupling the electric dipole to the first and second multiply-fed loops via a network of transmission lines.

28. The method as recited in claim 27, further comprising coupling an input feed network to the network of transmission lines, wherein the input feed network is configured for supplying substantially equal amounts of input power to the electric dipole and the multiply-fed loops.

* * * * *